United States Patent [19]

Taitel

[11] Patent Number: 4,614,336

[45] Date of Patent: Sep. 30, 1986

[54] PASSIVE-TYPE TREADMILL

[76] Inventor: Charles M. Taitel, 35 Union Rd., Parsippany, N.J. 07054

[21] Appl. No.: 695,057

[22] Filed: Jan. 25, 1985

Related U.S. Application Data

[62] Division of Ser. No. 517,079, Jul. 25, 1983, Pat. No. 4,544,152.

[51] Int. Cl.[4] ..... A63B 23/06

[52] U.S. Cl. ..... 272/69

[58] Field of Search ..... 272/69, 96; 29/DIG. 73; 119/29; 198/860, 842, 843; 128/25 B, 57

[56] References Cited

U.S. PATENT DOCUMENTS 759,296 5/1904 Morairty ..... 272/69

3,650,529 3/1972 Salm et al. ..... 272/69

*Primary Examiner*—Richard J. Apley

*Assistant Examiner*—S. R. Crow

*Attorney, Agent, or Firm*—Louis Weinstein

[57] ABSTRACT

A passive treadmill having a governor to adjustably limit the rate of speed of the treadmill belt. Resilient flexible rotating blades flex due to the centrifugal force developed during rotation, the magnitude of the centrifugal force being a function of the linear speed of the treadmill belt. Brake pads mounted on the flexible blades move into sliding engagement with an annular stationary surface to limit the linear speed of the treadmill belt. A rotatably mounted cam is manually adjustable to adjust the spacing between the aforesaid slidably engageable surfaces to adjust the governor. The governor assembly is of relatively small size and volume and the moving components of the governor are mounted within a compact casing.

The rollers, which rollingly support the treadmill belt, are rotatably mounted within elongated openings provided in each of a pair of mounting rails. Roller support shafts are inserted into slots arranged at spaced intervals along the support rails and a compressible rope is arranged between the support shafts and the upper interior surface of the support rail elongated openings. A single elongated rod in the elongated opening of each rail supports all of the associated shafts, providing the dual functions of securing said roller shafts in position and rotatably supporting all of the roller shafts at a uniform height. The compressible rope compensates for any tolerances between the parts and prevents the roller shafts, and hence the rollers, from experiencing any undesirable movement and/or vibration.

4 Claims, 17 Drawing Figures

PASSIVE-TYPE TREADMILL

This is a division of application Ser. No. 417,079 filed July 25, 1983 now U.S. Pat. No. 4,544,152.

FIELD OF THE INVENTION

The present invention relates to treadmills, and more particularly, to treadmills of the passive type, typically employed for exercise purposes and including a flywheel and a governor having axially adjustable, flexible rotating blades axially movable by an adjustment cam and cooperating with a stationary surface for limiting the linear velocity of the treadmill belt which engages the roller coupled to the flexible blades of the governor, and further including method and apparatus for assembling the treadmill rollers along support rails in a simplified manner, said method assuring precise horizontal and vertical alignment of the roller shafts.

BACKGROUND OF THE INVENTION

Treadmills are presently utilized as advantageous means for performing vigorous exercise indoors and at a stationary position. Such treadmills are typically comprised of an elongated closed-loop belt supported by a plurality of rotatable rollers arranged at closely-spaced parallel intervals and being mounted in a freewheeling manner. In order to limit the linear speed of the belt, it is typical to provide a flywheel. The user holds on to the treadmill rail to control speed. Only one known treadmill employs a governor which is both complicated and expensive. It is, therefore, desirable to provide a governor for treadmills and the like which is simple to use and having a simplified and yet rugged and reliable design to enable rapid adjustment of the treadmill linear speed.

DESCRIPTION OF THE INVENTION

The present invention provides a treadmill assembly which is characterized by a novel governor having rotatable flexible blades adjustably moveable in the axial direction about the center of rotation and having brake pads at the free end of the blades for slidable engagement with a cooperating stationary annular surface. The blades are mounted upon a shaft normally urging the blades away from the stationary annular surface. Cam means is provided to adjust the axial position of said flexible blades relative to said stationary surface. The centrifugal force developed by the rotating blades cause the blade ends to deflect toward the stationary surface, the amount of deflection being a function of the magnitude of the centrifugal force. The cam means thus serves as a means for limiting the linear speed of the treadmill in a simple and straightforward manner.

The treadmill belt is supported by a plurality of rollers arranged at closely-spaced, parallel intervals, said rollers being supported by a pair of rails each provided with a roller supporting section having an elongated opening communicating with a plurality of slots open ended at their bottom ends for receiving the roller shafts. The roller shafts are maintained at the proper height and are retained within said slots by means of an elongated rod inserted into said elongated opening and arranged beneath said roller shafts. An elongated resilient member is arranged in each of said elongated openings to compensate for any dimension deviations due to normal tolerances, and thereby prevent the roller shafts from experiencing any linear movement.

OBJECTS OF THE INVENTION AND BRIEF DESCRIPTION OF THE FIGURES

It is, therefore, one object of the present invention to provide a novel governor for use in treadmill assemblies and the like, said governor employing axially positionable flexible rotating blades adapted to experience substantially linear movement in a direction parallel to the rotational axis of the blades and further including adjustable cam means for controlling the position of said blades along their longitudinal axis to adjust the position of the brake pads carried by the blades relative to a cooperating stationary annular surface, and thereby control and limit the linear speed of the treadmill.

Still another object of the present invention is to provide a governor for treadmill assemblies and the like, which is of simple, compact design thereby providing a compact governor assembly capable of being arranged within a small housing.

Still another object of the present invention is to provide a treadmill assembly incorporating a plurality of closely-spaced rollers supported by the roller support sections of a pair of rails, each rail support section having an elongated opening and a plurality of slots communicating with said opening each receiving one of the roller shafts and including an elongated rod extending through each of said elongated openings for supporting the shafts of said rollers extending into said opening, and for retaining said shafts in said rail.

Still another object of the present invention is to provide a treadmill assembly of the character described in which rope-like resilient compressible means is arranged in each of said elongated openings above said roller shafts to restrain the roller shafts from experiencing any undesirable linear displacement.

The above as well as other objects of the present invention will become apparent when reading the accompanying description and drawings in which.

Figure 3A:
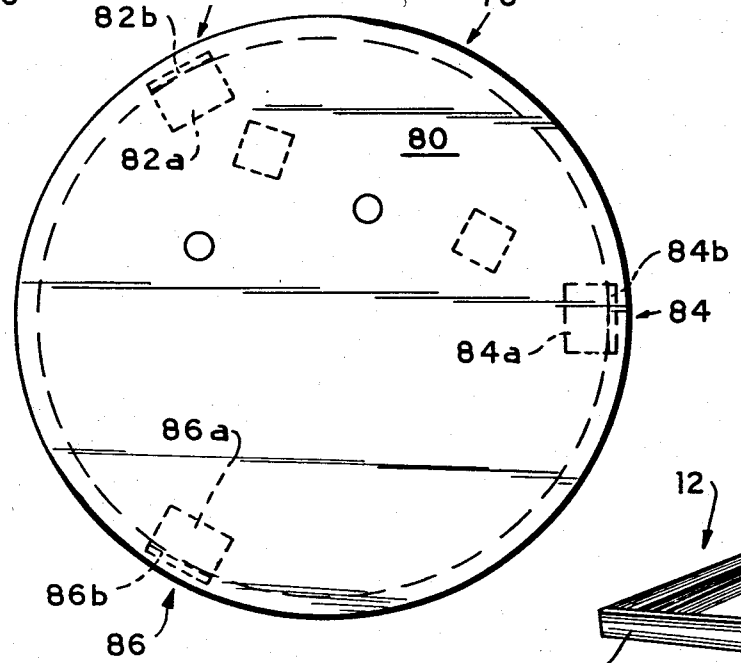
Figure 3B:
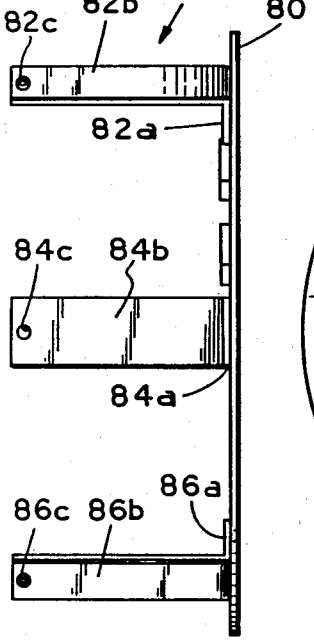
Figure 2:
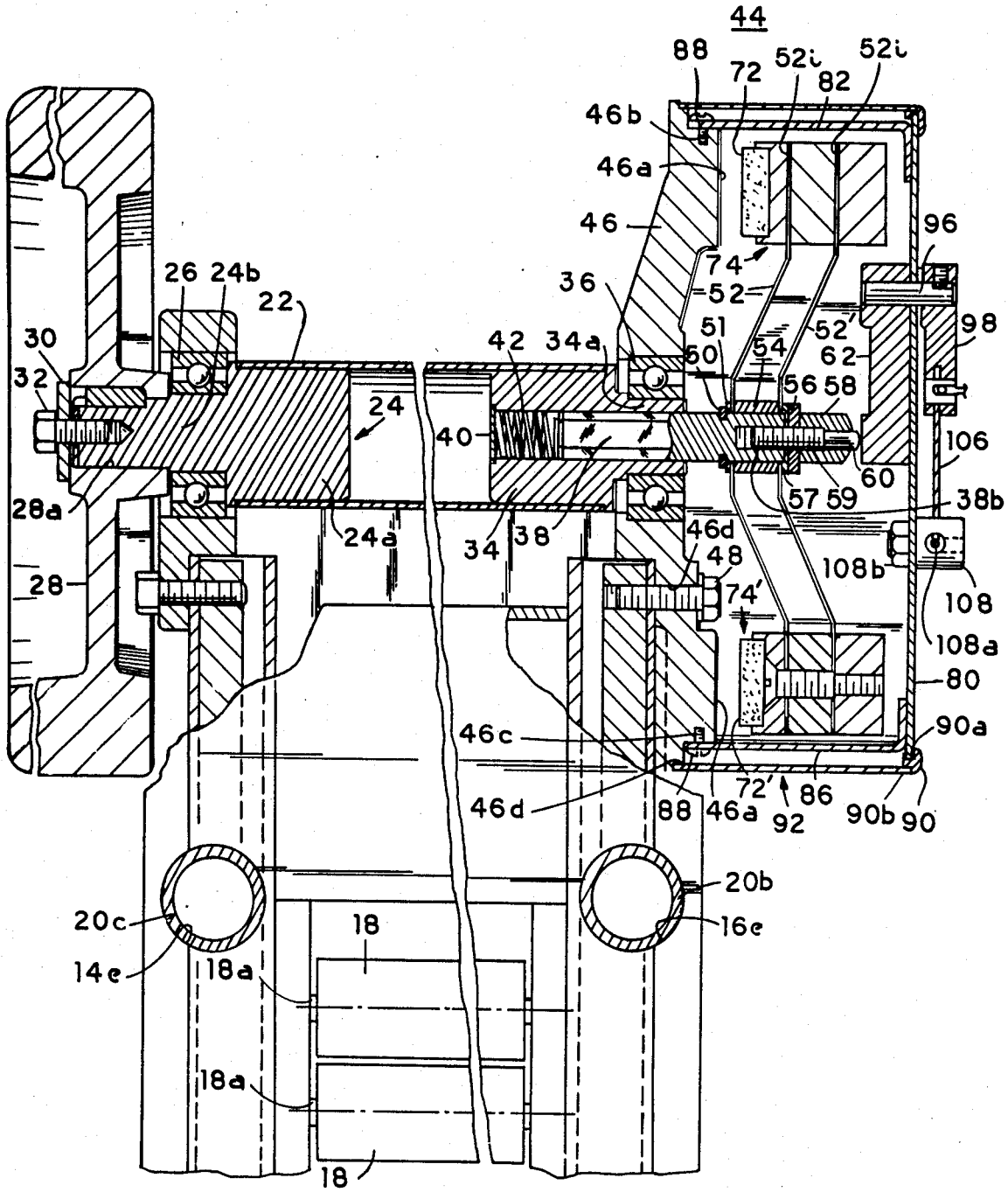
FIG. 2 shows a broken top plan view of the treadmill assembly of FIG. 1, in which portions thereof are sectionalized for facilitating the understanding of the present invention.

FIGS. 3*a* and 3*b* show plan and side elevations respectively, of a spider employed in the governor assembly of FIG. 2.

Figure 4:
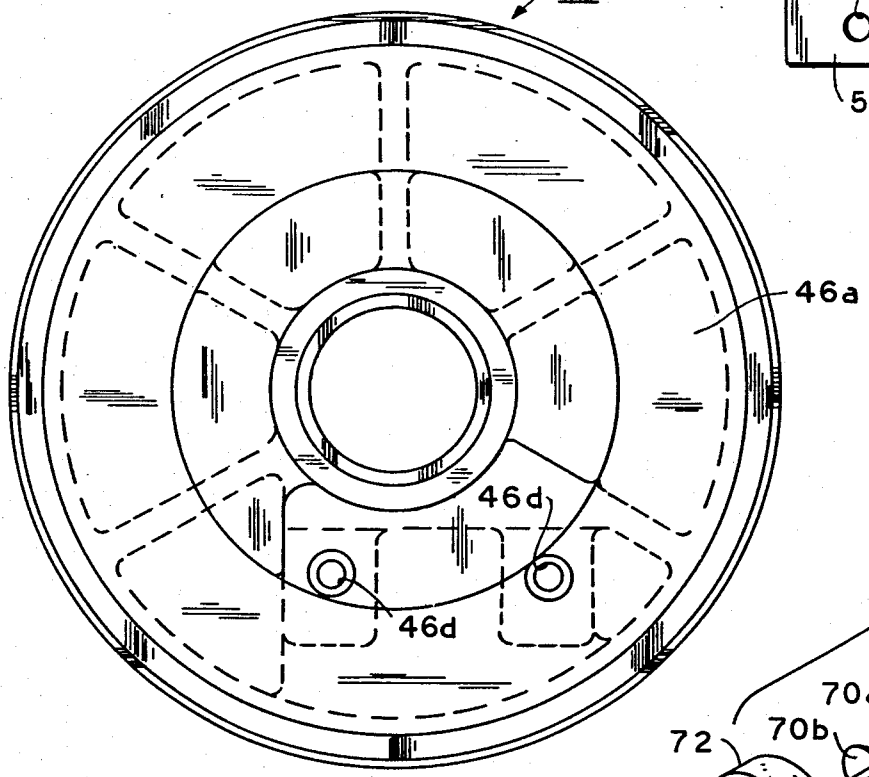

FIG. 4 is an end view of a brake disc employed in the governor of FIG. 2.

Figure 5:
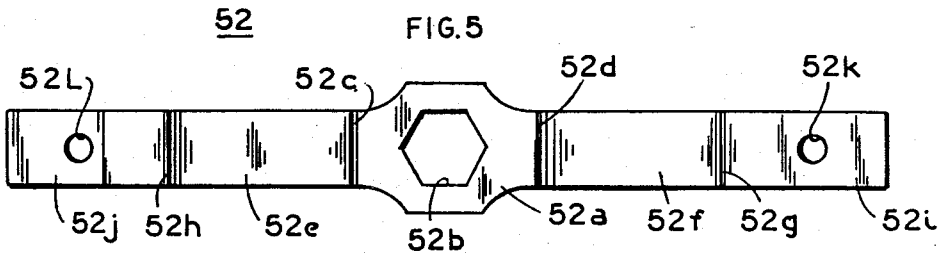

FIG. 5 is a plan view of one of the flexible resilient springs of the governor shown in FIG. 2.

Figure 6:
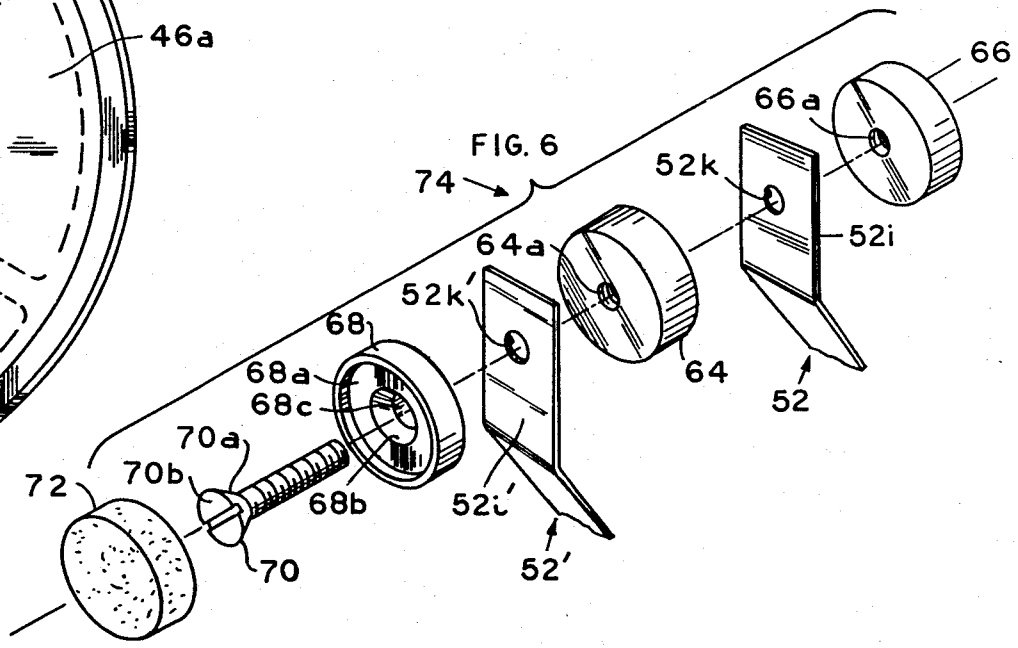

FIG. 6 is an exploded perspective view showing the brake pad and spacer assembly of FIG. 2 in greater detail.

Figure 7:
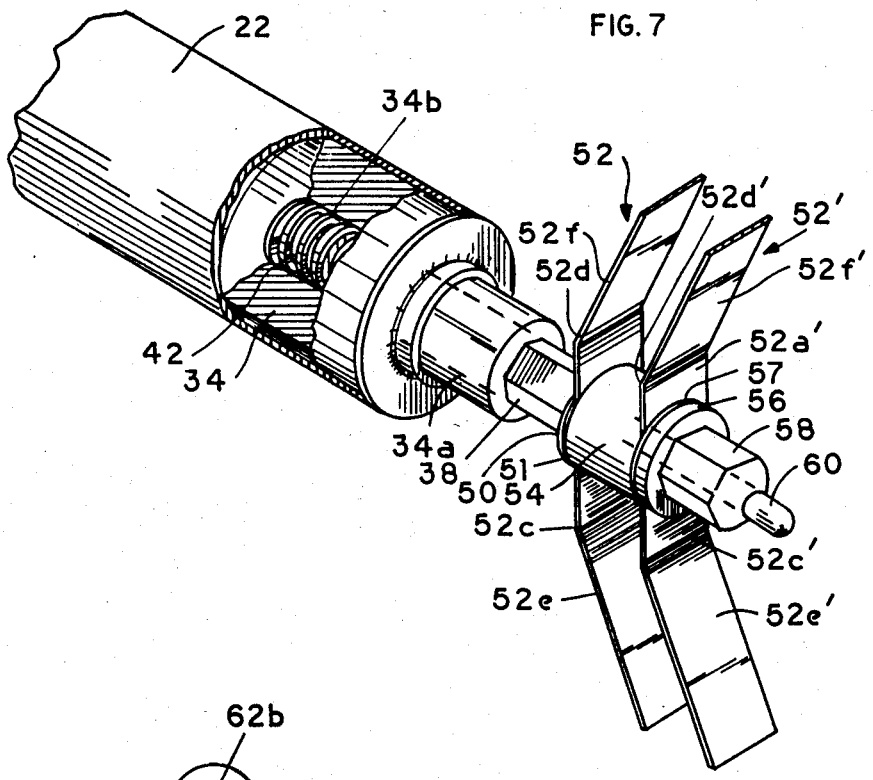

FIG. 7 is a partially exploded perspective view showing the shaft sub-assembly of the governor assembly of FIG. 2 in greater detail.

Figure 8A:
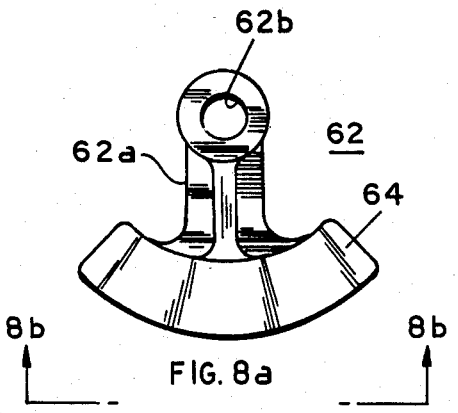
Figure 8B:
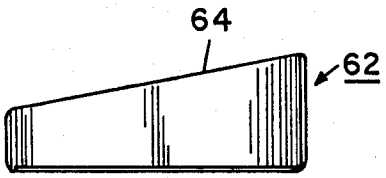

FIGS. 8*a* and 8*b* show plan and end views respectively, of the cam assembly employed in the governor assembly of FIG. 2.

Figure 9:
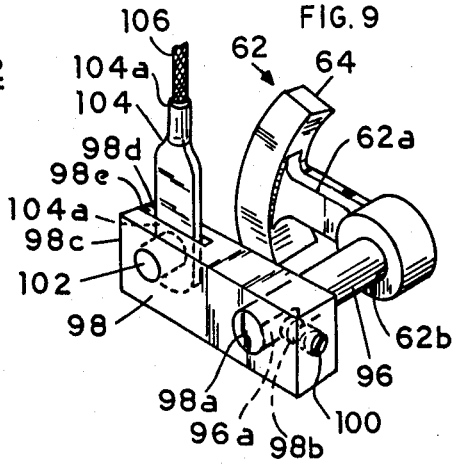

FIG. 9 shows a perspective view of the cam and lever assembly employed in the governor assembly of FIG. 2.

Figure 10:
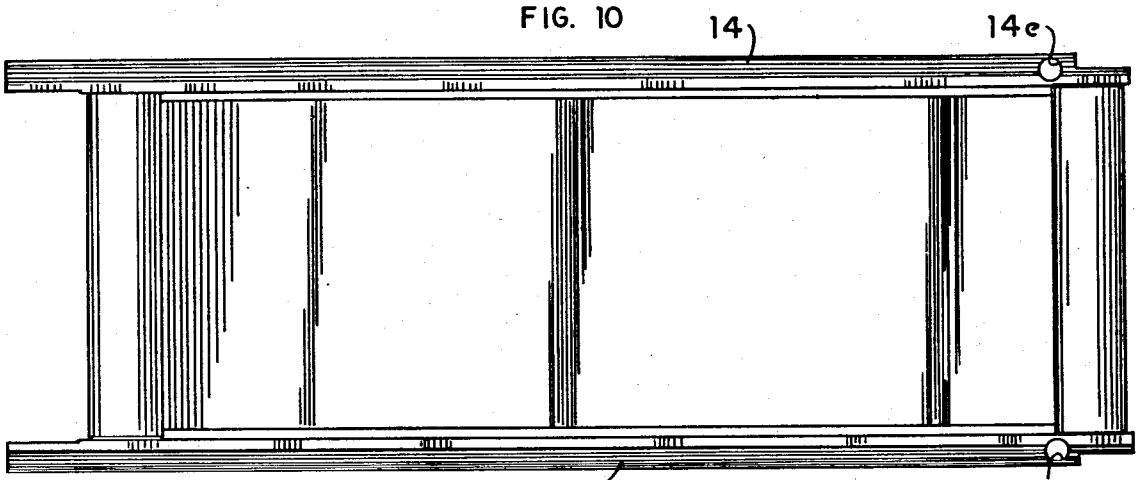

FIG. 10 shows a top plan view of the frame assembly employed in the treadmill assembly of FIG. 2.

Figure 10A:
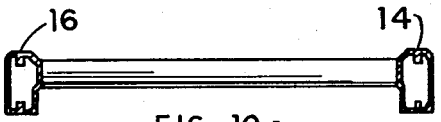
Figure 10B:
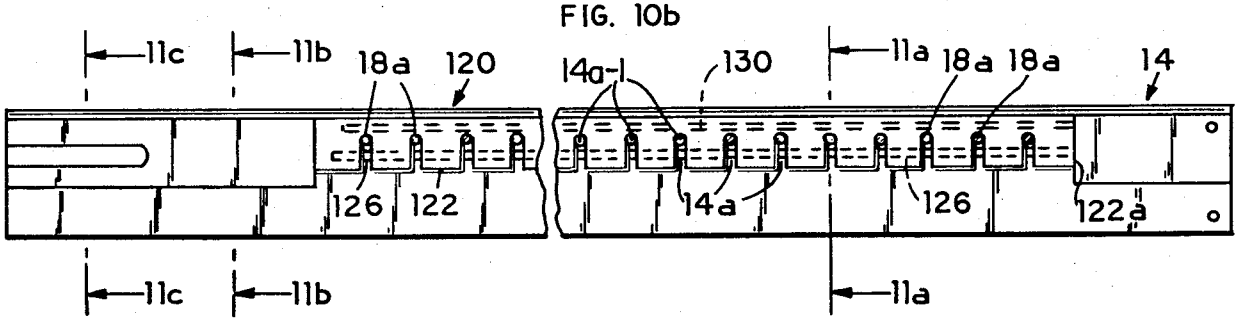

FIGS. 10*a* and 10*b* show end and side views of the frame as shown in FIG. 10.

Figure 11C:
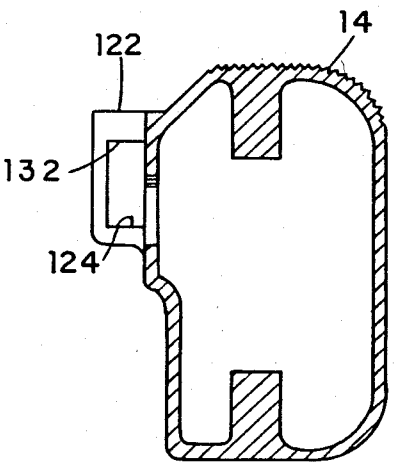
Figure 11B:
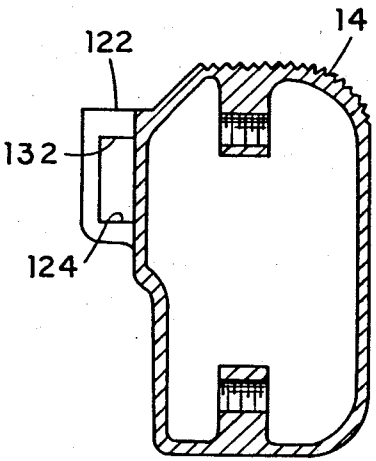
Figure 11A:
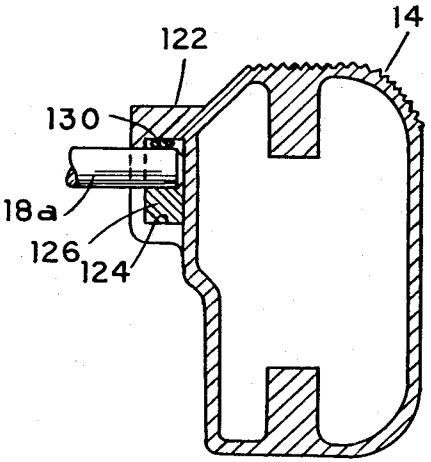

FIGS. 11*a*, 11*b* and 11*c* show sectional views taken along the lines 11*a*—11*a*, 11*b*—11*b* and 11*c*—11*c* of FIG. 10*b*.

DETAILED DESCRIPTION OF THE INVENTION

Figure 1:
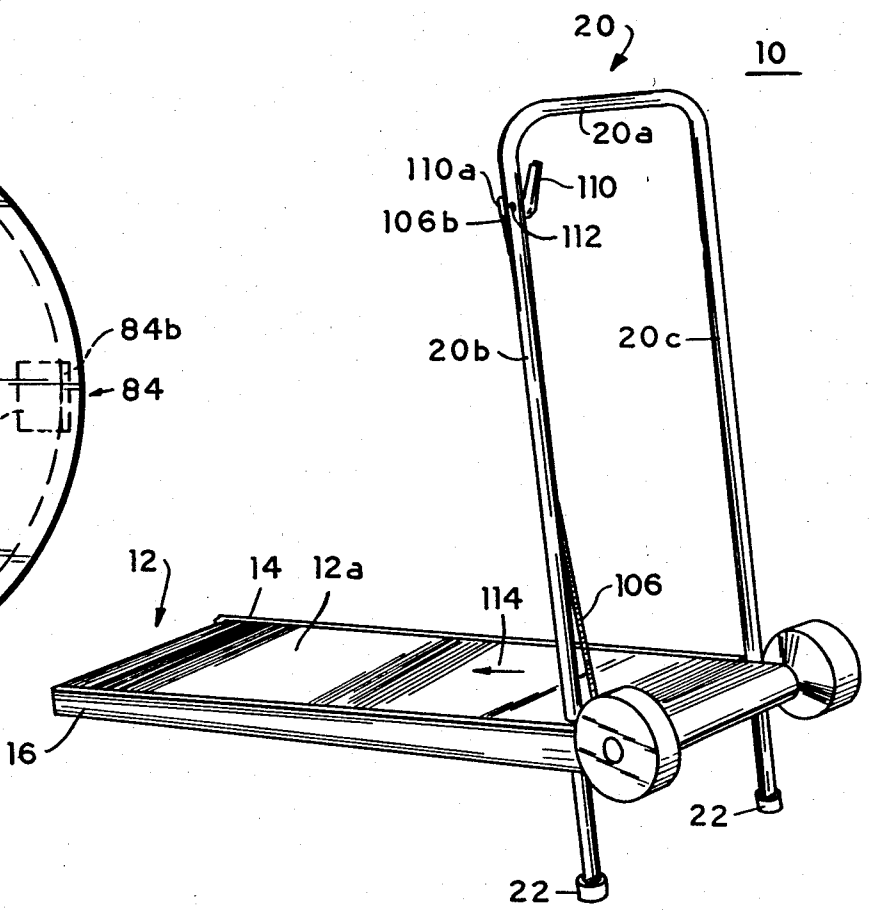
FIG. 1 shows a perspective view of a treadmill assembly designed in accordance with the principles of the present invention.

FIG. 1 shows a treadmill 10 embodying the principles of the present invention and comprised of a treadmill belt 12 arranged between a pair of rails 14 and 16, shown best in FIGS. 10–10*b*. The left-hand ends of rails 14 and 16 are designed to rest upon a floor or other suitable supporting surface.

A plurality of rollers 18 (see FIG. 2) are arranged between rails 14 and 16, and have their shafts 18*a*, as shown in FIGS. 2, 10*b* and 11*a*, extending into openings 14*a*, 16*a* provided at spaced intervals along each of the confronting inner surfaces of the roller supporting sections of rails 14 and 16. FIG. 10*b* shows one set of openings 14*a* arranged at spaced intervals along the roller supporting section 122 of rail 14.

U-shaped bar or handle assembly 20 of treadmill 10 is comprised of a yoke portion 20*a* for gripping by a treadmill user, if desired. Downwardly depending arms 20*b* and 20*c* terminate in feet covered with rubber-like supporting cups 22, 22. The arms 20*b* and 20*c* extend through openings 14*e*, 16*e* in rails 14 and 16, and are secured thereto by suitable fastening means (see FIGS. 1 and 10).

As shown in FIG. 2, continuous closed loop treadmill belt 12, in addition to encircling rollers 18, encircles a forward-most roller comprised of hollow cylindrical member 22, whose left-hand end receives the right-hand end 24*a* of a support member 24, the end 24*a* being force-fitted into the left-hand end of hollow cylinder 22. Intermediate portion 24*b* of member 24 is journaled within bearing assembly 26, while the left-hand end 24*c* of member 24 extends through the central opening 28*a* in flywheel 28. Washer 30 and fastener 32 secure flywheel 28 to member 24, and hence to roller 22. The bearing 26 is mounted within an opening 27*a* in support member 27, joined to rail 14 by fastener 29.

The right-hand end of hollow cylindrical member 22 force-fittingly receives the left-hand end of hollow shaft supporting member 34, whose right-hand end 34*a* is journaled within bearing assembly 36, which is arranged within opening 46*e* in governor base plate 46 (see FIGS. 2 and 4). Member 34 (note FIG. 7) has a hexagonal-shaped bore of a cross-sectional configuration adapted to conform to and slidably receive elongated hexagonal shaft 38. A closure cap 40 closes and seals the left-hand end of the hexagonal-shaped opening in member 34. Helical spring 42 is positioned between cap 40 and the left-hand end of hexagonal shaft 38. Shaft 38 is slidable within member 34, and is normally urged to the right by spring 42. The right-hand end of shaft 38 extends into governor assembly 44 comprised of generally circular-shaped base plate 46, which is joined to rail 16 by fasteners 48, 48 extending through openings 46*d* in base plate 46 (see FIG. 4).

A retaining ring 50 is secured within an annular groove 38*c* in shaft 38 intermediate its ends and is engaged by ring-shaped member 51, which engages a first flexible blade 52, having a central portion 52*a* provided with a hexagonal-shaped central opening 52*b* (see FIG. 5). Flexible blade 52 is bent along bend lines 52*c* and 52*d* to form the diagonally-aligned portions 52*e* and 52*f*, and is further bent along bend lines 52*g* and 52*h* forming radially aligned free end portions 52*i* and 52*j*, each having an opening 52*k* and 521, respectively. A spacer 54 having a generally cylindrical outer surface and a hexagonal-shaped hollow interior, is placed over shaft 38 and provides the desired spacing between flexible blade 52 and flexible blade 52', which is substantially identical to blade 52. A circular-shaped disk 57 having a hexagonal-shaped recess 57*a* is placed against and receives the right-hand end of shaft 38. The marginal portion of disk 57 rests against blade 52' and is positioned between the right-hand surface of the central portion 52*a* of blade 52' and ring-shaped washer 56, and is retained in place by hexagonal-shaped nut 58, having a threaded portion 58*a*, which threadedly engages a threaded member 59 which also engages the tapped interior portion 38*b* of shaft 38. An elongated button-like cylindrical-shaped member 60 having a low friction bearing surface is force-fitted into the opening in the right-hand end of nut 58 and its rounded tip is arranged to slidably engage the diagonally-aligned cam surface 64 of a pivotally mounted cam member 62 shown in FIGS. 2, 8*a*, 8*b* and 9. The diagonally-aligned cam surface 64 adjustably controls the position occupied by button 62, which in turn determines the position of shaft 38, which is moved either toward the left or toward the right, relative to the position occupied by cam member 62, thereby movably positioning flexible blades 52, 52'.

The free ends 52*i*, 52*i'* of blades 52, 52', shown best in FIGS. 2, 5 and 6, receive and support a brake assembly comprised of a cylindrical disk 64 serving as a spacer arranged between blade portions 52*i*, 52*i'*, a second circular disk 66 arranged against the right-hand surface of blade portion 52*i* and a third circular disk 68 arranged against the left-hand surface of blade portion 52*i'*.

Circular disk 68 is provided with a recess 68*a* having a central opening 68*b*, which tapers to a narrower clearance opening 68*c*, which extends through the right-hand side of disk 68. Disks 64 and 66 each have threaded central openings 64*a*, 66*a* for receiving and threadedly engaging threaded fastener 70 to secure the brake assembly comprised of blade ends 52*i*, 52*i'* and disks 64, 66 and 68. The threaded fastening member 70 has a head portion with a tapered configuration 70*a*, which is received within the tapered portion provided in disk 68 between openings 68*b* and 68*c*. Thus the top surface 70*b* of fastener 70 is substantially flush with the recessed surface 68*a* of disk 68.

A brake pad in the form of a circular disk 72 is positioned within recess 68*a* and is preferably adhesively secured therein. It should be noted in FIG. 2 that a pair of brake pad assemblies 74, 74' are provided at each end of the pair of flexible blades. The brake pads 72, 72' are positioned to selectively engage an annular surface 46*a* provided inwardly of the periphery of governor base plate 46. The brake pads are preferably formed of felt.

The governor assembly 44 is covered by a spider 78, shown best in FIGS. 2, 3*a* and 3*b*, which spider is comprised of a cylindrical disk 80 having three L-shaped legs 82, 84, 86, the short leg portions 82*a*, 84*a* and 86*a* being joined to the interior surface of the disk 80, for example, by welding, and the long leg portions 82*b*, 84*b* and 86*b* extending away from disk 80 and toward governor base plate 46. Each of the legs 82–86 is provided with an opening 82*c*, 84*c*, 86*c* at its free end, each of said openings receiving a fastening member 88, which threadedly engages tapped openings, such as for example, tapped openings 46*b*, 46*c* in base plate 46, for securing spider 80 to base plate 46. Opening 80*a* in disk 80 receives shaft 96, which supports cam member 62 (See FIG. 9), and opening 80*b* supports guide member 108 (see FIG. 2).

A gasket 90 encircles the periphery of disk 80 and is provided with a continuous groove 90*a* for embracing the peripheral edge of disk 80 (see FIG. 2). An elongated flexible sheet is arranged to rest upon a first shoulder 90*b* provided in gasket 90, and a second shoulder 46*d* arranged about the periphery of base plate 46. Sheet 92 encircles and encloses the governor assembly 44.

The adjustable cam 62 is provided with a mounting opening 62*b* at the end of arm 62*a*, shown best in FIGS. 2, 8*a* and 9. Shaft 96 is force-fitted into opening 62*b* in cam member 62 and has its opposite end extending into opening 98*a* in lever arm 98. The left end of shaft 96 is provided with a flat 96*a* for engagement by a set screw 100, which threadedly engages tapped opening 98*b* in lever arm 98, which tapped opening communicates with opening 98*a* in order to secure shaft 96 to lever arm 98. As was mentioned above, shaft 96 extends through opening 80*a* in disk 80 (see FIG. 3*a*).

The left-hand end of lever arm 98 is provided with a pair of bifurcated arms 98*c*, 98*d* defined by a slot 98*e* arranged therebetween. An opening is provided in each of the arms 98*c*, 98*d* for receiving pin 102, which extends through these openings, as well as an opening 104*a* in a cable anchor 104, whose upper end 104*a* is secured to one end of a cable 106. Cable 106 extends through an opening 108*a* in post 108 secured to spider disk 80 by fastening member 108*b*. The cable extends upwardly along arm 20*b* of U-shaped handle assembly 20, shown in FIG. 1, and has its upper end 106*b* secured to the anchoring end 110*a* of handle 110, which is pivotally mounted to arm 20*b* by pin 112. By swinging handle 110, cable 106 is moved respectively up or down, causing the movement of lever arm 98, which extends through opening 80*a* in spider cylindrical disk 80, as shown best in FIG. 2, in order to rotate lever arm 98 and cam 62.

The position of rotatable cam 62 controls the positioning of button 60 and hence flexible arms 52, 52' and brake shoes 72, 72' relative to the cooperating stationary surface 46*a*.

The governor 44 assembly operates as follows:

A person standing upon the treadmill belt 12 may either walk or run in the "uphill" direction, i.e., in a direction from the left toward the right, relative to FIG. 1, causing the upper run 12*a* of treadmill belt 12 to move in the direction shown by arrow 114. The treadmill belt engages hollow cylindrical roller 22, causing it to rotate. Member 34 and hexagonal shaft 38 rotate together with hollow cylindrical roller 22, causing the rotation of flexible blades 52, 52'. The flexible blades 52, 52' develop a centrifugal force, the magnitude of which controls the deflection of the diagonal portions 52*e*, 52*e'*, 52*f*, 52*f'* of the flexible blades 52*e*, 52*e'* towards the left, the greater the angular velocity, the greater the deflection. As the angular velocity and hence the amount of deflection increases, the brake pads 72, 72', mounted to the ends of blades 52, 52' engage stationary annular surface 46*a* to limit the angular velocity of roller 22 and hence treadmill belt 12. By adjusting cam member 62 to move shaft 38 further toward the right, the drag imposed upon treadmill belt 12 by the governor assembly 44 is reduced or even removed, allowing the treadmill to move at a faster rate. Conversely, by moving cam member 62 to move shaft 38 further toward the left and against the force of spring 42, the maximum speed of treadmill belt 12 is decreased.

Due to the unique shape of the flexible blades 52, 52', the outward radial movement of the brake assemblies 74, 74' is minimal, providing a governor assembly of small, compact size, most of the movement of the brake assembly 74, 74' occurring in a direction substantially parallel to the axis of rotation of the blades.

The housing of the governor assembly is arranged to be easily and readily removed and replaced to simplify the periodic removal and replacement of the brake pads 72, 72'.

As was mentioned hereinabove, treadmill belt 12 is supported by a plurality of closely-spaced rollers 18. Each roller 18 is mounted upon a shaft 18*a*, the free ends of which extend outwardly from the free ends of the roller 18. The rails 14 and 16 are provided with an intermediate portion 120, shown best in FIGS. 10*b* and 11*a*–11*c*, said intermediate portion having an elongated hollow rectangular-shaped roller shaft supporting section 122, extending inwardly from each rail, such as for example, the rail 14 shown in FIGS. 11*a*–11*c*. The hollow-shaped shaft supporting section 122 is provided with an elongated substantially rectangular-shaped hollow interior 124. In order to mount the shafts 18*a* of rollers 18, slots 14*a* are machined into the inwardly extending projection 122 at regular intervals, as shown in FIG. 10*b*. The slots 14*a* are open at their bottom ends.

At least one end of the hollow interior 124 provided in hollow shaft supporting section projection 122 is open.

Once the slots 14*a* are machined or otherwise formed in shaft supporting section 122, one end of the shafts 18*a* are each inserted upwardly into one of the slots 14*a* to be arranged in the manner shown in FIGS. 10*b* and 11*a*. The shafts 18*a* are lifted upwardly to rest against the upper end 14*a*-1 of each slot 14*a* and an elongated rod 126, preferably having a rectangular-shaped cross-section, is inserted through the open right-hand end of section 122 and into hollow elongated interior 124. The rollers 18 and shafts 18*a* are lifted, in order to pass rod 124 beneath each of the shafts 18*a*, so that the rod 126 supports all of the shafts 18*a* at a uniform height.

An elongated resilient compressible rope-like member 130 is preferably initially inserted into hollow elongated opening 124, in order to be positioned between rollers 18*a* and the interior top surface 132 of elongated opening 134. The diameter of rope-like member 130 is preferably greater than the distance between top interior wall 132 and engaging portion of roller shaft 18*a* to provide a tight fit of shaft 18*a* within slot 14*a*, and to prevent any "play" between shafts 18*a*, rod 126 and shaft supporting section 122.

Rod 124 supports all of the rollers 18*a* at a proper uniform height, while rope-like member 130 compensates for any play between the shaft 18*a*, the upper end of each slot 14*b* and elongated rod 126. Elongated rod 126 serves the dual function of supporting all of the roller shafts at the proper uniform height and of retaining all of the shafts 18*a* in their operating position without the need for any fastening means whatsoever. It should be understood that the mounting arrangement provided in rail 16 is identical to that described in connection with rail 14. Preferably rope-like member 130 is placed within hollow interior 124 prior to insertion of the shafts 18*a* into slots 14*a*.

The rails 14 and 16 are preferably formed through an extrusion process, thus further significantly reducing the cost of components as well as reducing the fabrication and assembly costs.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A treadmill assembly comprising a pair of elongated rails arranged in spaced parallel fashion;

each of said rails having a hollow roller shaft support section projecting inwardly toward the opposite rails and having sidewalls facing one another, each of said sections having a hollow interior;

said sidewalls being joined to their associated rails by top and bottom sides;

a plurality of slots being formed in the bottom sides and the bottom portions of the facing sidewalls of said sections and extending upwardly and having their upper ends below the top ends of said sidewalls, said slots being arranged at regularly-spaced intervals;

a treadmill belt;

a plurality of rollers for rollingly supporting the treadmill belt and having shaft portions at each end thereof inserted into an associated one of said slots of each of said rails, so that the free ends of said shafts extend into the hollow interior of said support sections, said treadmill belt encircling said rollers;

an elongated rod for each shaft support section arranged in each section and extending over the length of each of the elongated hollow interiors of said support shafts, the free ends of each of said shafts resting upon said rod, each rod being supported by said bottom side and bridging the slots in said bottom side.

2. The treadmill assembly of claim 1 further comprising an elongated resilient rope-like member extending over substantially the entire length of the hollow interior of each of said section and being positioned between the top side of the hollow interior of said section and the adjacent surfaces of the shafts extending into said hollow interior to substantially prevent said shafts from movement and to compensate for any play of the members within said supporting assembly.

3. The treadmill assembly of claim 1, wherein the hollow interior of each section is generally rectangular in shape.

4. The treadmill assembly of claim 3, wherein each elongated rod has a rectangular cross-section.

* * * * *

UNITED STATES PATENT AND TRADEMARK OFFICE

CERTIFICATE OF CORRECTION

PATENT NO. : 4,614,336

DATED : September 30, 1986

INVENTOR(S) : Charles M. Taitel

It is certified that error appears in the above-identified patent and that said Letters Patent is hereby corrected as shown below:

Column 4, line 12, change "52a" to --52a'--

Column 5, line 57, change "52f" (second occurence) to --52f'--.

Signed and Sealed this

Fourteenth Day of April, 1987

*Attest:*

DONALD J. QUIGG

*Attesting Officer*

*Commissioner of Patents and Trademarks*